US007159712B1

(12) United States Patent
Chen

(10) Patent No.: US 7,159,712 B1
(45) Date of Patent: Jan. 9, 2007

(54) TOOLBOX

(76) Inventor: Kun-Chen Chen, No. 6, Lane 609, Sec. 1, Chung-Shan Rd., Yer-Her Li, Tachia Chen, Taichung Hsien (TW)

( * ) Notice: Subject to any disclaimer, the term of this patent is extended or adjusted under 35 U.S.C. 154(b) by 0 days.

(21) Appl. No.: 11/343,131

(22) Filed: Jan. 30, 2006

(51) Int. Cl.
*B65D 85/28* (2006.01)

(52) U.S. Cl. ..... 206/349; 206/373; 220/23.4

(58) Field of Classification Search ..... 206/349, 206/372–379; 220/23.2, 23.4, 23.8, 23.83; 312/902

See application file for complete search history.

(56) References Cited

U.S. PATENT DOCUMENTS 4,951,812 A * 8/1990 Chen ..... 206/373
5,366,071 A * 11/1994 Laszlo ..... 206/373
6,062,385 A * 5/2000 Cho ..... 206/373
6,264,030 B1 * 7/2001 Tsou ..... 206/372
6,533,138 B1 * 3/2003 Chwen-Ru ..... 206/373
6,612,435 B1 * 9/2003 Chang ..... 206/373
6,648,166 B1 * 11/2003 Levy ..... 206/373

* cited by examiner

*Primary Examiner*—Luan K. Bui
(74) *Attorney, Agent, or Firm*—Alan D. Kamrath; Nikolai & Mersereau, P.A.

(57) ABSTRACT

The toolbox has a primary case, two add-on cases and four pivot pins. The primary case has a front casing and a rear housing. The rear casing has two pivoting sides, two locking hinges and multiple hinge barrels. The add-on cases are pivotally attached to the pivoting sides and each has a connecting casing and a pivoting housing. Each connecting casing is attached to one of the pivoting sides and each has multiple hinge barrels and a resilient clamp. Each pivoting casing is attached to the corresponding connecting casing oppositely to the rear casing and has a locking hinge, multiple hinge barrels and a slice. The pivot pins are separately pass through the locking hinges and the corresponding hinge barrels of the rear housing, the corresponding hinge barrels of the connecting casing and the locking hinges and the corresponding hinge barrels of the pivoting housing.

2 Claims, 7 Drawing Sheets

TOOLBOX

BACKGROUND OF THE INVENTION

1. Field of the Invention

The present invention relates to a toolbox, and more particularly to a toolbox that can be attached to another toolbox quickly and easily.

2. Description of Related Art

Conventional toolboxes are used to store handheld tools or instruments and many types. With reference to FIG. 6, a conventional toolbox (50) makes carrying tools and instruments and usually has a front casing (51), a rear casing (52), a tool compartment and a handle (53). The front casing (51) has an inside surface and at least one recess. The at least one recess is formed in the inside surface. The rear casing (52) is pivotally attached to the front casing (51) and has an inside surface and at least one recess. The at least one recess is formed in the inside surface and may correspond to the at least one recess in the inside surface of the front casing (51). The inner compartment is formed by the at least one recess in the inside surfaces of the front and rear casing (51, 52) and holds hand tools or instruments. The handle (53) is attached to the front casing (51) or the rear casing (52) and detachably connects to the other casing (51, 52) to hold the conventional toolbox (50) closed.

Even though, the tool compartment of the conventional toolbox (50) can hold hand tools or instruments, the conventional toolbox (50) has a capacity that is restricted by the size of the conventional toolbox (50) because the conventional toolbox (50) cannot be expanded conveniently.

To overcome the shortcomings, the present invention provides a toolbox that can be attached to another toolbox quickly and easily to mitigate or obviate the aforementioned problems.

SUMMARY OF THE INVENTION

The main objective of the present invention is to provide a toolbox that can be attached to another toolbox quickly and easily.

The toolbox has a primary case, two add-on cases and four pivot pins. The primary case has a front casing and a rear housing. The rear casing has two pivoting sides, two locking hinges and multiple hinge barrels. The add-on cases are pivotally attached to the pivoting sides and each has a connecting casing and a pivoting housing. Each connecting casing is attached to one of the pivoting sides and each has multiple hinge barrels and a resilient clamp. Each pivoting casing is attached to the corresponding connecting casing oppositely to the rear casing and has a locking hinge, multiple hinge barrels and a slice. The pivot pins are separately pass through the locking hinges and the corresponding hinge barrels of the rear housing, the corresponding hinge barrels of the connecting casing and the locking hinges and the corresponding hinge barrels of the pivoting housing.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
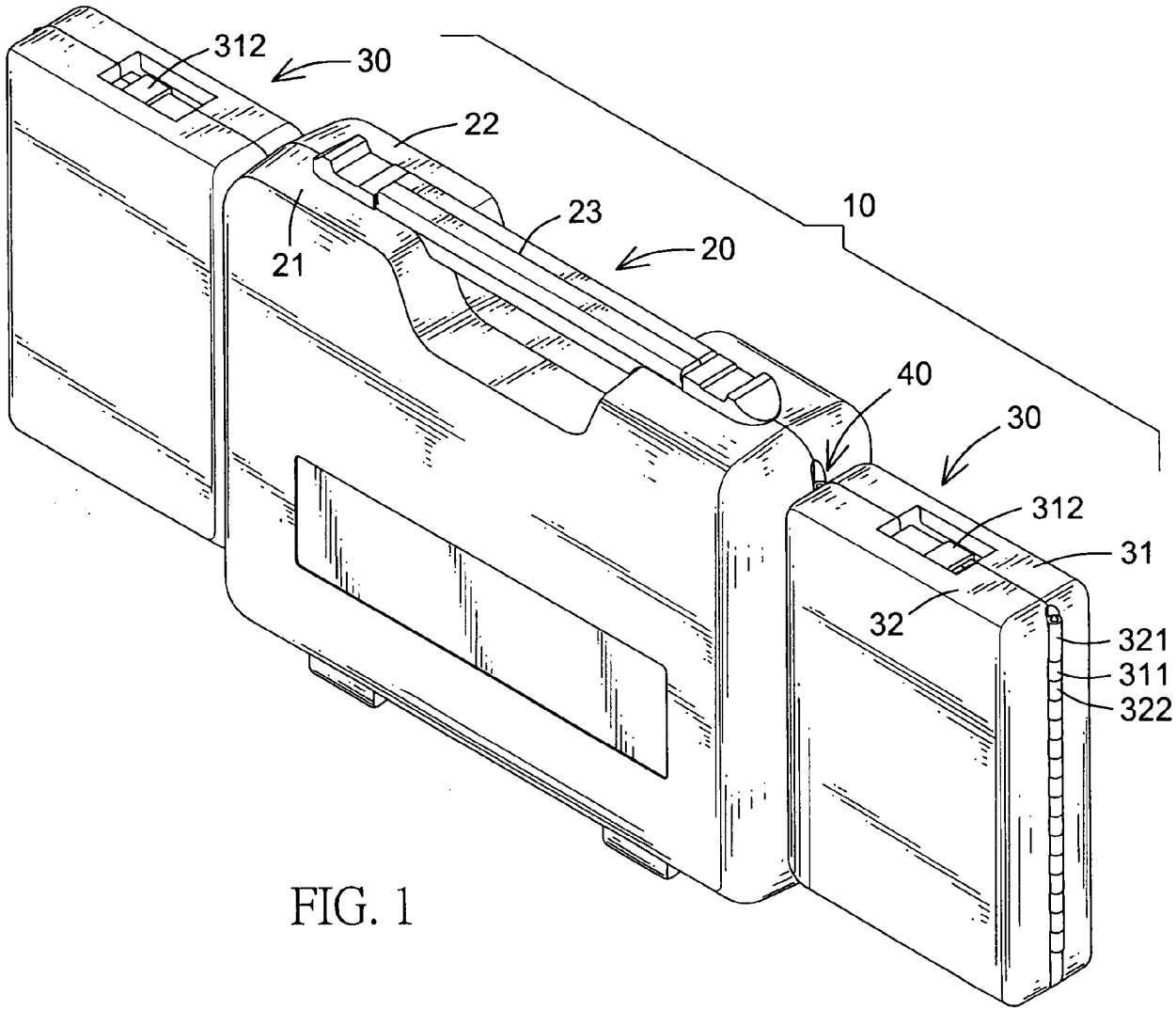
FIG. 1 is a perspective view of a toolbox in accordance with the present invention.
Figure 2:
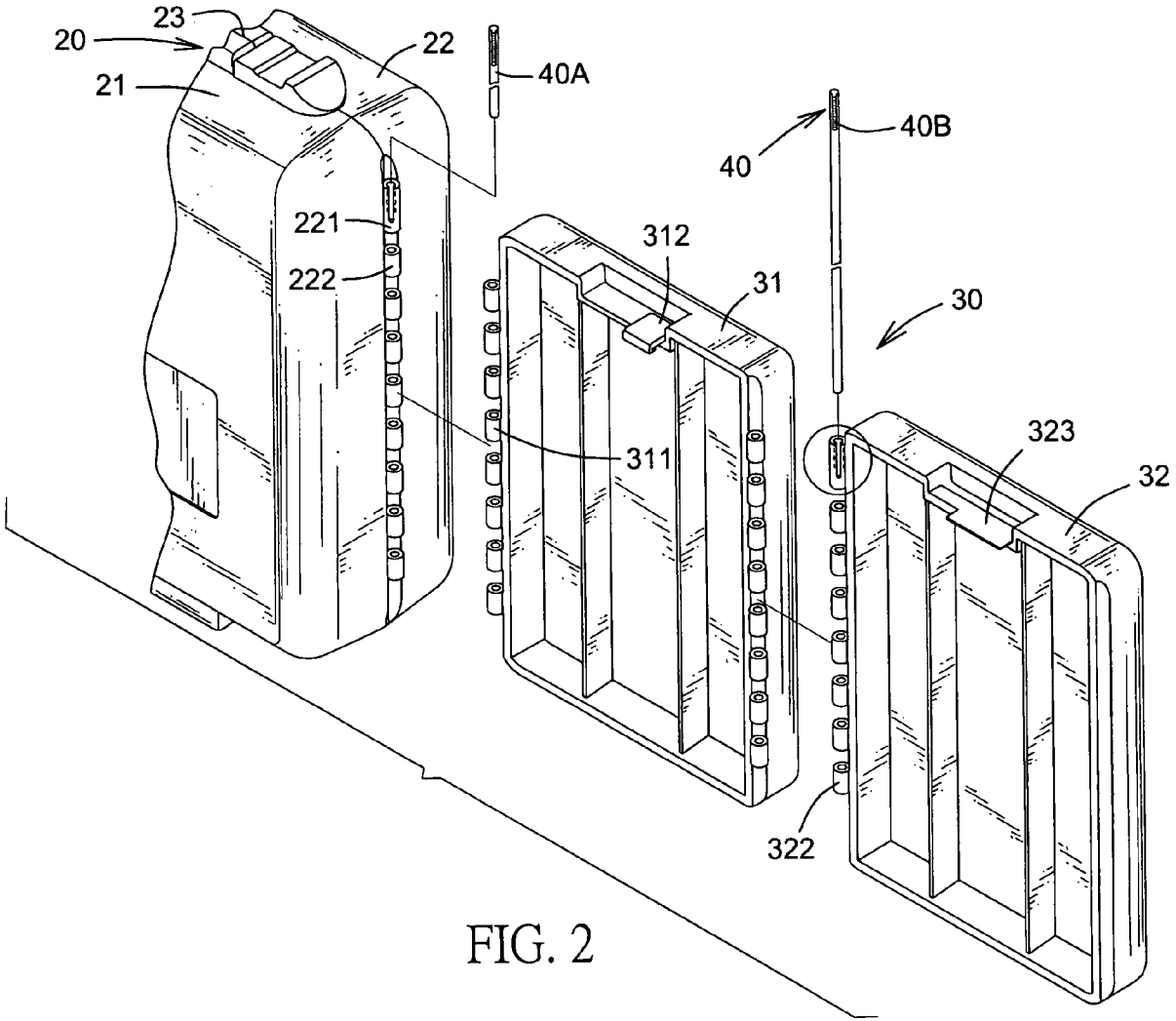
FIG. 2 is an operational perspective view of the toolbox in FIG. 1 with an add-on case open and exploded.

With reference to FIGS. 1 and 2, a toolbox (10) in accordance with the present invention comprises a primary case (20), two add-on cases (30) and four pivot pins (40).

The primary case (20) has a front casing (21), a rear casing (22), a tool compartment and a handle (23). The front casing (21) has a top, a bottom, two ends and a closed front.

Figure 3:
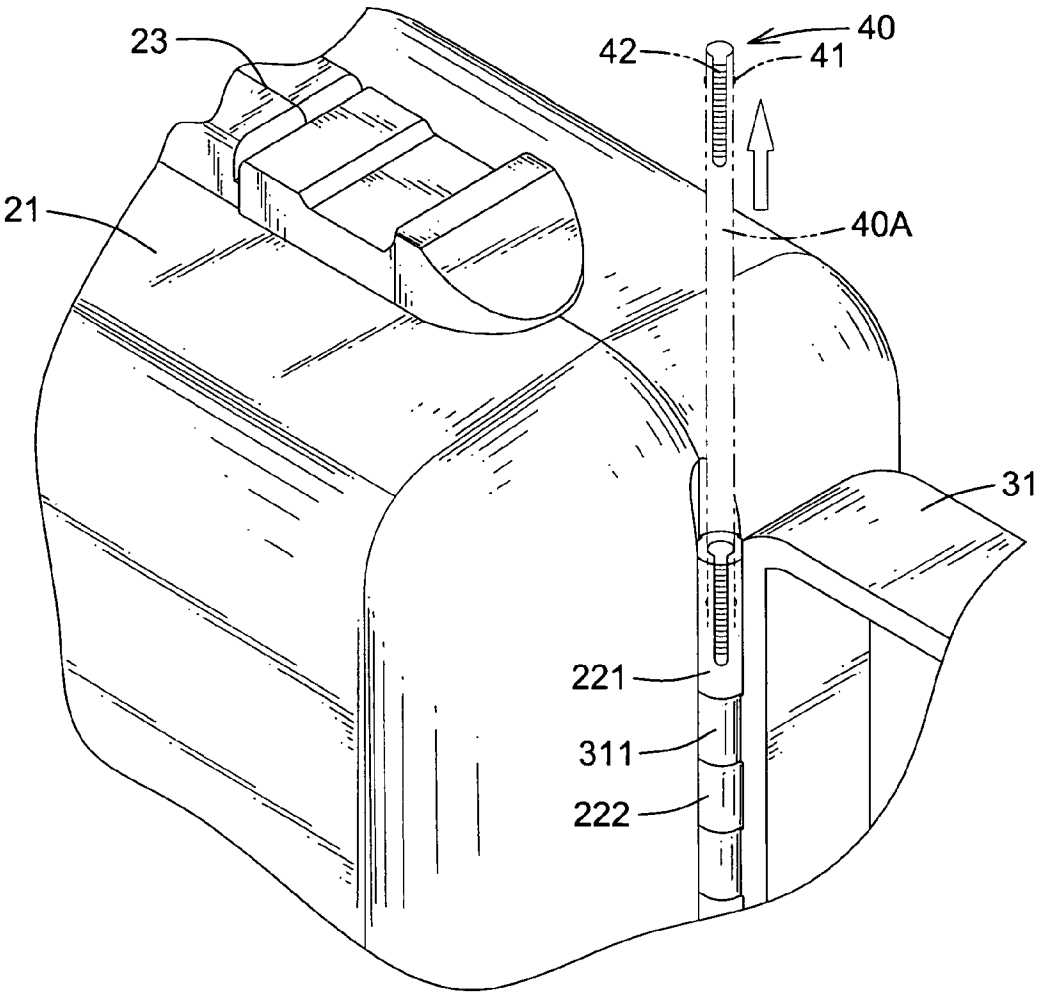
FIG. 3 is an enlarged operational perspective view of the toolbox in FIG. 1 with a pivot pin removed from a corresponding locking hinge and hinge barrel.
Figure 4:
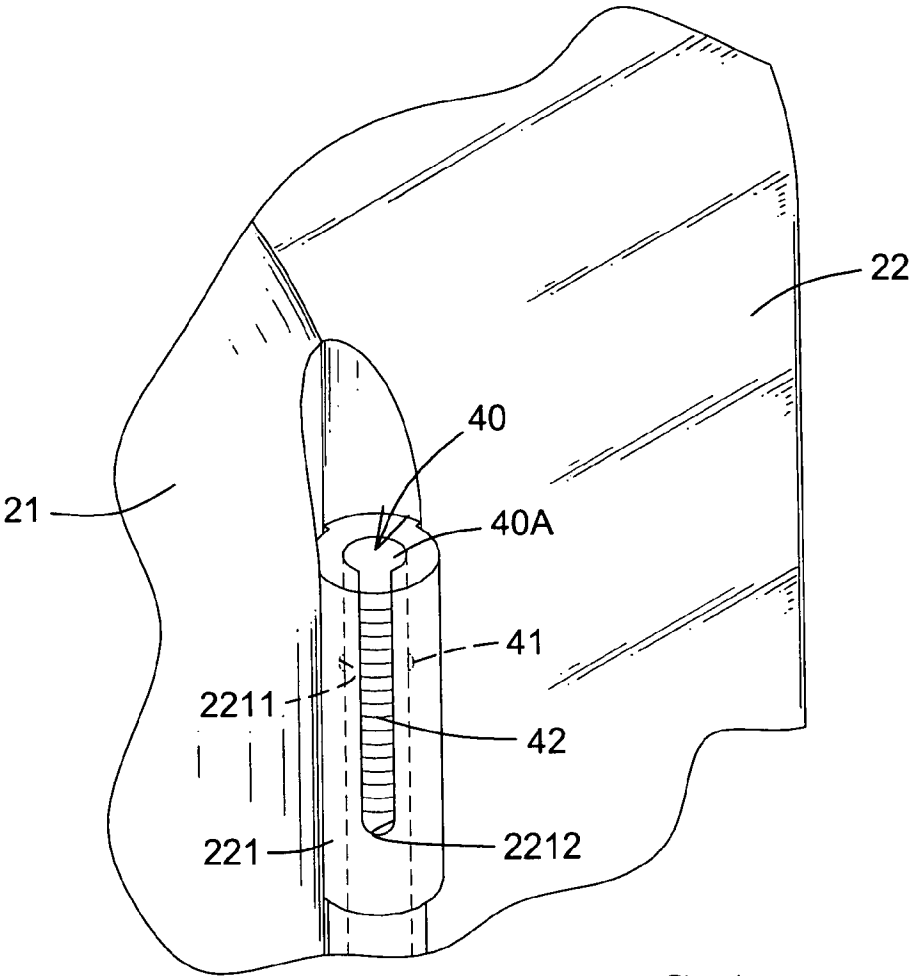
FIG. 4 is an enlarged operational perspective view of the toolbox in FIG. 3.

With further reference to FIGS. 3 and 4, the rear casing (22) is attached pivotally to the bottom of the front casing (21) and has a top, a bottom, a closed rear, two pivoting sides, two locking hinges (221) and multiple hinge barrels (222). The bottom connects pivotally to the bottom of the front casing (21). The locking hinges (221) are respectively mounted on the pivoting sides of the rear casing (22) and each has a mounting hole, an inner surface, two buckled grooves (2211) and a lateral groove (2212). The mounting hole is extended through the locking hinge (221) and the buckled grooves (2211) are formed on the inner surface and opposite each other. The lateral groove (2212) is formed on the locking hinge (221) between the buckled grooves (2211) and communicates to the mounting hole. The hinge barrels (222) are separately mounted perpendicularly on the pivoting sides below the locking hinges (221) and each hinge barrel (222) has a pivot hole. The pivot holes of the hinge barrels (222) communicate with each other and communicate to the mounting hole of the corresponding locking hinge (221).

The handle (23) is attached between the front casing (21) and the rear casing (22) and provide user to raise and carry.

Figure 2A:
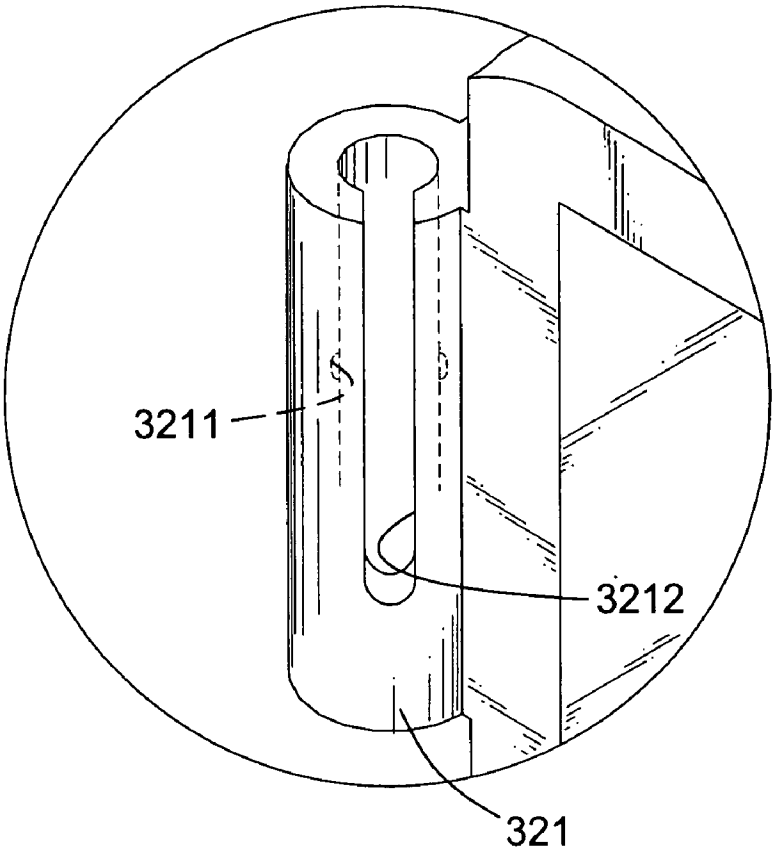
FIG. 2A is an enlarged operational perspective view of the toolbox in FIG. 2 with an add-on case open and exploded.

With reference to FIGS. 2 and 2A, the add-on cases (30) are attached pivotally and separately to the pivoting sides of the rear casing (22) and each has a connecting casing (31) and a pivoting casing (32).

Figure 5:
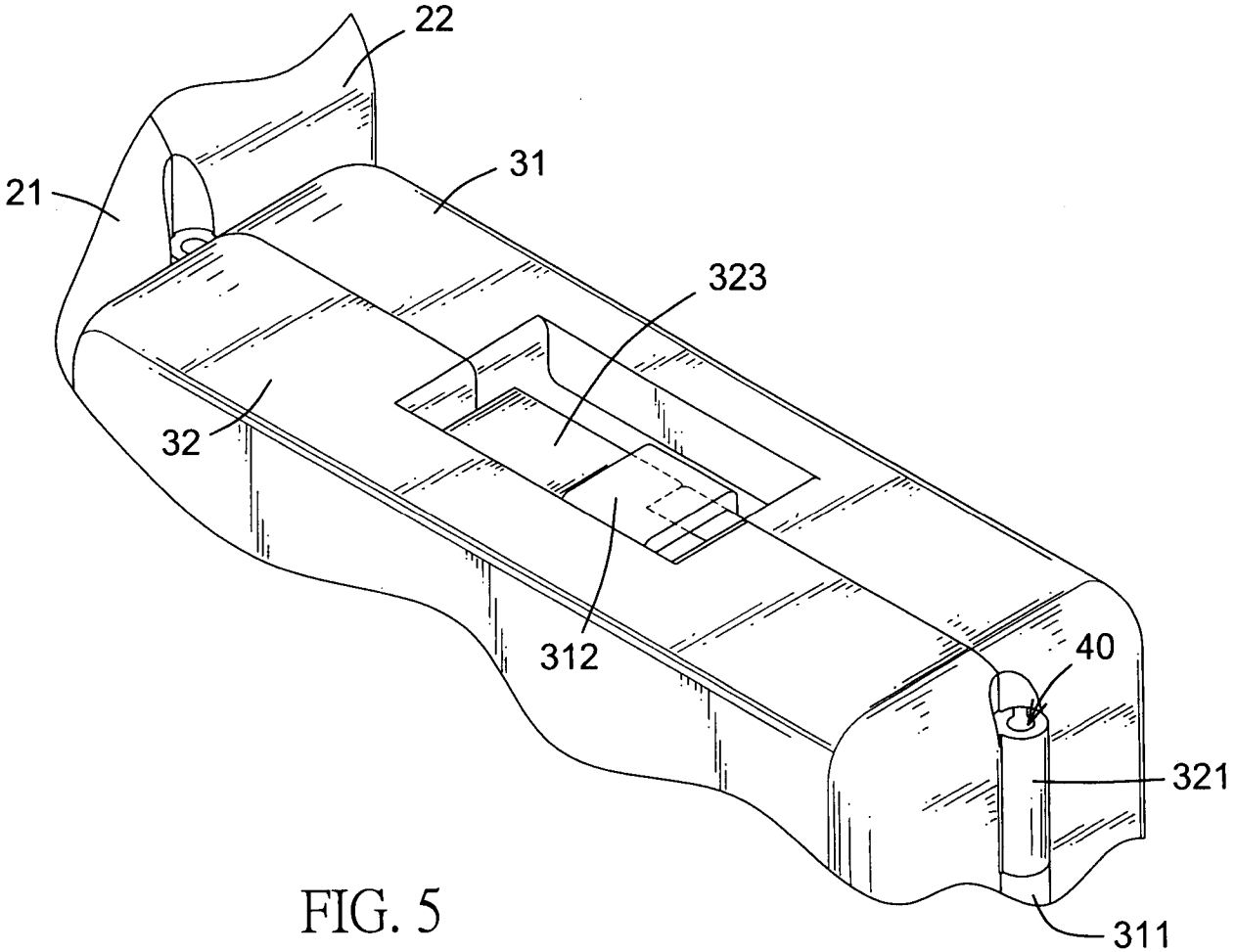
FIG. 5 is an enlarged operational perspective view of the toolbox in FIG. 1.
Figure 6:
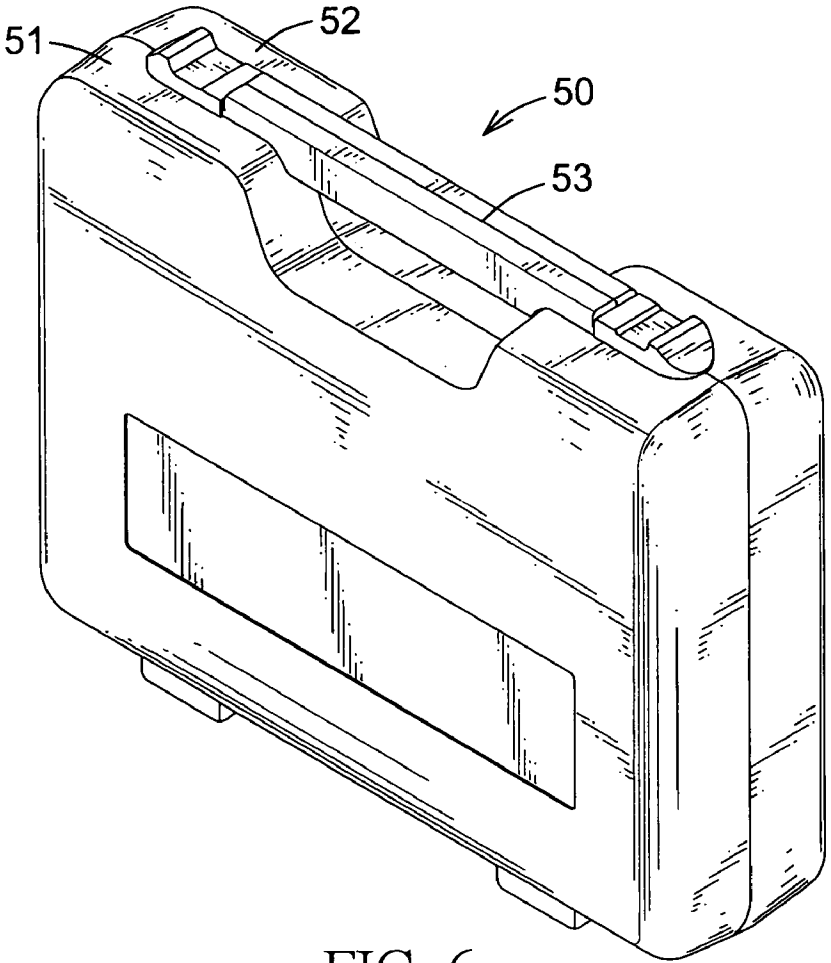
FIG. 6 PRIOR ART
FIG. 6 is a perspective view of a conventional toolbox in accordance with the prior art.

Each connecting casing (31) is attached to one of the pivoting sides in the rear casing (22) of the primary case (20) and has two connecting sides, a locking side, multiple hinge barrels (311) and a resilient clamp (312). The hinge barrels (311) are formed on the connecting sides of the connecting casing (31) and the hinge barrels (311) in one of the connecting sides corresponding to and aligning with the hinge barrels (222) and the locking hinge (221) of the rear casing (22). With reference to FIGS. 2 and 5, the resilient clamp (312) is detachably mounted in the locking side of the connecting casing (31) and has two clasps. One of the clasps is engaged with the locking side of the connecting casing (31).

Each pivoting casing (32) is pivotally attached to the correspond connecting casing (31) oppositely to the rear casing (22) and has a hinging side, a locking side, a locking hinge (321), multiple hinge barrels (322) and a slice (323). The locking hinge (321) is mounted on the hinging side and has a mounting hole, an inner surface, two buckled grooves (3211) and a lateral groove (3212). The mounting hole is extended through the locking hinge (321) and the buckled grooves (3211) are formed on the inner surface and opposite each other. The lateral groove (3212) is formed on the locking hinge (321) between the buckled grooves (2211) and communicates to the mounting hole. The hinge barrels (322) are perpendicularly mounted on the hinging side below the locking hinge (321) and each hinge barrel (322) has a pivot hole. The pivot holes of the hinge barrels (322) communicate each other and the mounting hole of the locking hinge (321). The slice (323) is formed on the locking side and corresponds to the resilient clamp (312) in the connecting casing (31) and engages with the other clasp of the resilient clamp (312). Then, the pivoting casing (32) can mount with the connecting casing (31) by the resilient clamp (312) and the slice (323).

With reference to FIGS. 2 and 3, the pivot pins (40) are mounted respectively with the primary case (20) and the add-on cases (30) and has two first pivot pins (40A) and two second pivot pins (40B). Each first pivot pin (40A) extends through a corresponding one of the locking hinges (221) on the rear casing (22), corresponding hinge barrels (222) on the rear casing (22) and the hinge barrels (311) on one of the connecting sides of the connecting casing (31) of a corresponding one of the at least one add-on case (30) to pivotally connect the primary case (20) with the connecting casing (31) of the corresponding add-on case (30). Each second pivot pin (40B) extends through the hinge barrels (311) on one of the connecting sides of the connecting casing (31) of a corresponding one of the at least one add-on case (30), the locking hinge (321) and the hinge barrels (322) of the pivoting casing (32) of the corresponding add-on case (30).

Each pivot pins (40A, 40B) has a distal end, a proximal end, an outer surface, two raised granules (41) and a nick (42). The raised granules (41) are respectively formed on the outer surfaces of the pivot pins (40A, 40B) and separately engaged with the corresponding buckled grooves (2211, 3211) of the locking hinges (221, 321). The nicks (42) are formed on the outer surfaces of the pivot pins (40) near the proximal ends and face to the corresponding lateral grooves (2212, 3212), and provide user to pull up the pivot pins (40) easily.

The toolbox (10) as described has the following advantages.

1. The toolbox (10) can store more handheld tools or instruments than the conventional toolbox (50) by extending the pivot pins (40) through the add-on cases (30) and the primary case (20). Then, user can store and carry more handheld tools or instruments and convenient in use.

2. The simplified design of the toolbox (10) causes the manufacturing and assembly to be cheaper and quicker.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A toolbox having a primary case having a front casing having a top;

a bottom;

two ends; and a closed front;

a rear casing attached pivotally to the bottom of the front casing and having a top;

a bottom connected pivotally to the bottom of the front casing;

a closed rear;

two pivoting sides;

two locking hinges respectively mounted on the pivoting sides of the rear casing and each having a mounting hole extended through the locking hinge;

an inner surface;

two buckled grooves formed on the inner surface and opposite each other; and a lateral groove formed on the locking hinge between the buckled grooves and communicating to the mounting hole; and multiple hinge barrels separately mounted perpendicularly on the pivoting sides and mounted respectively below the locking hinges, and each having a pivot hole communicating each other and communicating to the mounting hole of a corresponding locking hinge; and a handle attached between the front casing and the rear casing;

at least one add-on case attached pivotally to the rear casing and each having a connecting casing attached to one of the pivoting sides in the rear casing of the primary case and having two connecting sides;

a locking side;

multiple hinge barrels formed on the connecting sides of the connecting casing and the hinge barrels in one of the connecting sides corresponding to and aligning with the hinge barrels and the buckled hinge in a corresponding pivoting side of the rear casing; and a resilient clamp detachably mounted in the locking side of the connecting casing and having two clasps, and one of the clasps engaged with the locking side of the connecting casing; and a pivoting casing pivotally attached to the connecting casing oppositely to the rear casing and having a hinging side;

a locking side;

a locking hinge mounted on the hinging side and having a mounting hole extended through the locking hinge;

an inner surface;

two buckled grooves formed on the inner surface and opposite each other; and a lateral groove formed on the locking hinge between the buckled grooves and communicating to the mounting hole;

multiple hinge barrels perpendicularly mounted on the hinging side below the locking hinge and each having a pivot hole communicating each other and communicating to the mounting hole of the locking hinge; and a slice formed on the locking side and corresponding to the resilient clamp in the connecting casing and engaging with the other clasp of the resilient clamp; and at least two pivot pins mounted respectively with the primary case and the at least one add-on case, and having at least one first pivot pin each extending through a corresponding one of the locking hinges on the rear casing, corresponding hinge barrels on the rear casing and the hinge barrels on one of the connecting sides of the connecting casing of a corresponding one of the at least one add-on case to pivotally connect the primary case with the connecting casing of the corresponding add-on case, and each one of the at least one first pivot pin having a distal end;

a proximal end;

an outer surface; and two raised granules respectively formed on the outer surface of the pivot pin and engaged respectively with the buckled grooves of in the corresponding locking hinge on rear casing; and at least one second pivot pin each extending through the hinge barrels on one of the connecting sides of the connecting casing of a corresponding one of the at least one add-on case, the locking hinge and the hinge barrels of the pivoting casing of the corresponding add-on case, and each one of the at least one second pivot pin having a distal end;

a proximal end;

an outer surface; and two raised granules respectively formed on the outer surface of the pivot pin and engaged respectively with the buckled grooves of in the locking hinge on the corresponding pivoting casing.

2. The toolbox as claimed in claim 1, wherein each pivot pin has a nick forming on the outer surface near the proximal end and facing to the lateral groove of the locking hinge on a corresponding one of the rear casing and the pivoting casing.

* * * * *